US005688181A

United States Patent [19]

Albert

[11] Patent Number: 5,688,181

[45] Date of Patent: Nov. 18, 1997

[54] BOWLING AID

[76] Inventor: David M. Albert, 8448 Colonial Dr., Littleton, Colo. 80124

[21] Appl. No.: 571,094

[22] Filed: Dec. 11, 1995

[51] Int. Cl.[6] ..... A61F 5/04

[52] U.S. Cl. ..... 473/61; 473/60; 2/21

[58] Field of Search ..... 473/55, 56, 59, 473/60, 61, 62, 63; 2/21, 161.3, 163, 161.1; 602/22; 401/7, 8; 294/25

[56] References Cited

U.S. PATENT DOCUMENTS

| | | | |
|---|---|---|---|
| 622,386 | 4/1899 | Peery | 2/21 |
| 1,220,007 | 3/1917 | Rowley | 294/25 |
| 2,225,571 | 12/1940 | Smith | 294/25 |
| 2,935,354 | 5/1960 | Chapman | 294/25 |
| 3,038,723 | 6/1962 | Bergendorf . | |
| 3,046,561 | 7/1962 | Marinese et al. . | |
| 3,091,455 | 5/1963 | De Mire . | |
| 3,098,654 | 7/1963 | Larsen . | |
| 3,224,012 | 12/1965 | Hamm . | |
| 3,248,112 | 4/1966 | Metzger | 473/61 |
| 3,362,027 | 1/1968 | Petrov . | |
| 3,398,951 | 8/1968 | Disko . | |
| 3,563,545 | 2/1971 | Rasche . | |
| 3,595,575 | 7/1971 | Gooch . | |
| 3,606,319 | 9/1971 | Borden . | |
| 4,194,736 | 3/1980 | Loafman . | |
| 4,273,330 | 6/1981 | Buneta . | |
| 4,371,163 | 2/1983 | Shaffer et al. . | |
| 4,466,313 | 8/1984 | Gardner | 294/25 |
| 4,608,720 | 9/1986 | Purin | 473/61 |
| 5,095,897 | 3/1992 | Clark et al. | 602/22 |
| 5,330,391 | 7/1994 | Mitchell . | |

OTHER PUBLICATIONS

Spare–Time® (advertisement); Bowling; vol. 32, No. 3, Oct. 1965 (p. 31).

"How to Improve Your Grip Game"; Good–Win Super Bowl Gripper (advertisement); Bowling; May, 1973 (p. 47).

Super Touch™ (advertisement); Bowling; Mar. 1984 (p. 30).

Kicker™ (advertisement); Bowling; Mar. 1984 (p. 30).

Kicker™ (advertisement); Bowling; Jun./Jul. 1984 (p. 39).

Power Plus (advertisement); Sports Tec; at least as early as Aug. 9, 1995.

Bobby's Axle (advertisement); at least as early as Aug. of 1995.

"Comfy Sleeve" ™, Silicone Finger Sleeves, Red's Silicone Extrusions, Inc., 1725 Ocean Ave., Building #3, Raymond, Washington 98577, at least as eary as Apr. 1996.

*Primary Examiner*—William M. Pierce
*Attorney, Agent, or Firm*—Holland & Hart LLP

[57] ABSTRACT

A bowling aid adapted to be mounted on either the bowler's index or little finger. The aid is a rigid sheath into which the bowler's finger is inserted. Appropriate padding is provided in the sheath for gripping and protecting the finger. On the outer end of the sheath there is provided a plate which extends outwardly from the sheath and is provided with a concave surface with a frictional coating thereon for assisting the bowler in gripping the bowling ball. The concave surface and friction coating extend along the length and width of the sheath. The bowler presses the plate and the length and width of the sheath against the surface of the ball during bowling to generate enhanced grip.

27 Claims, 5 Drawing Sheets

FIG. 3
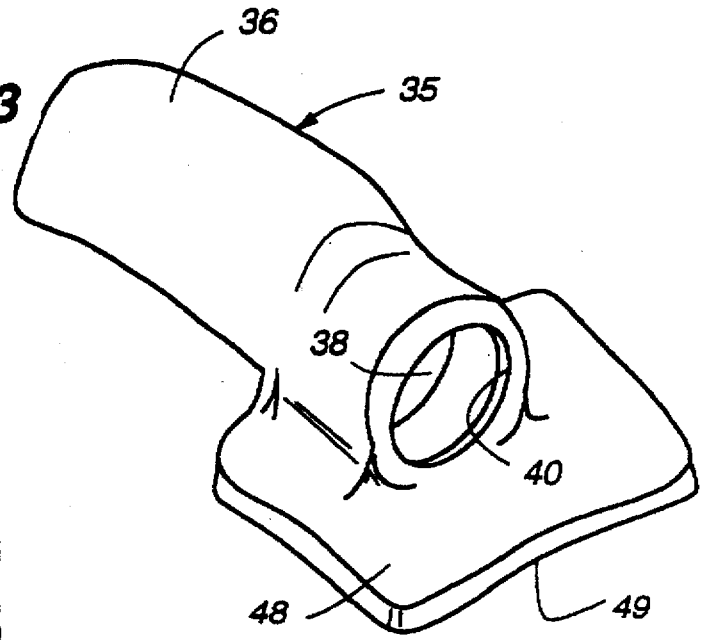
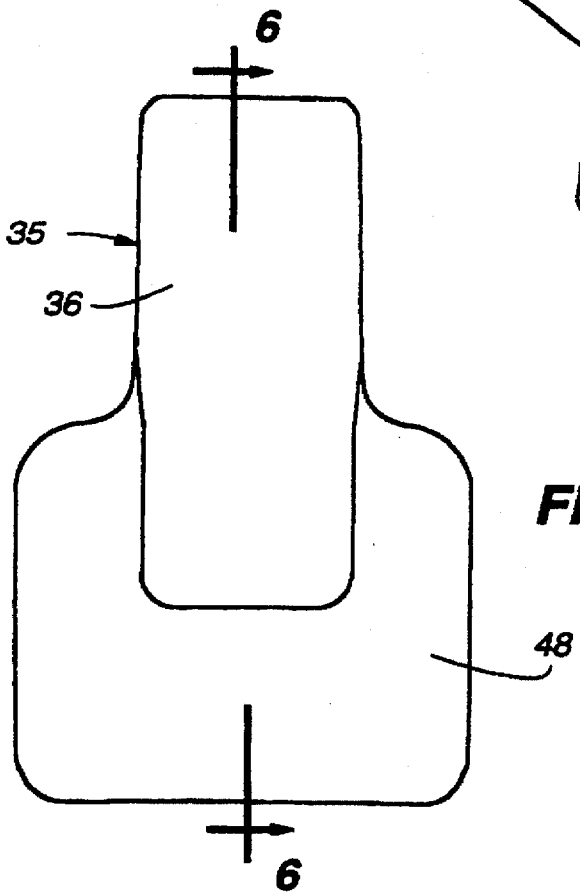
FIG. 4
FIG.5
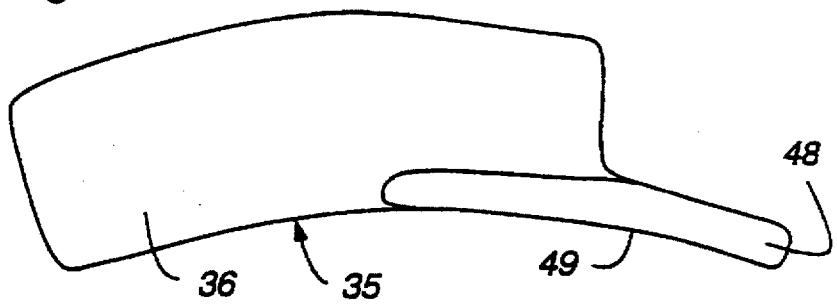

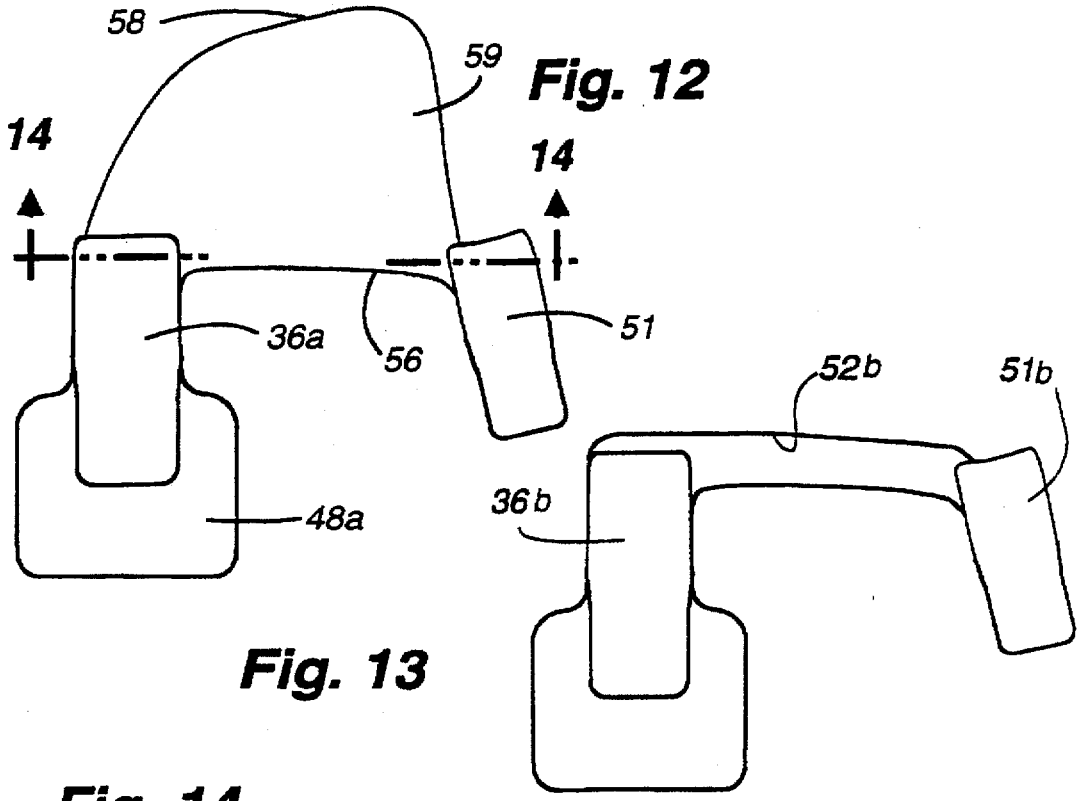
Fig. 12
Fig. 13
Fig. 14
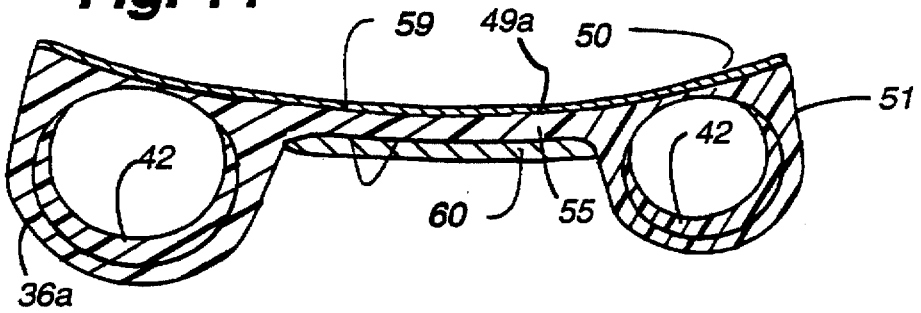
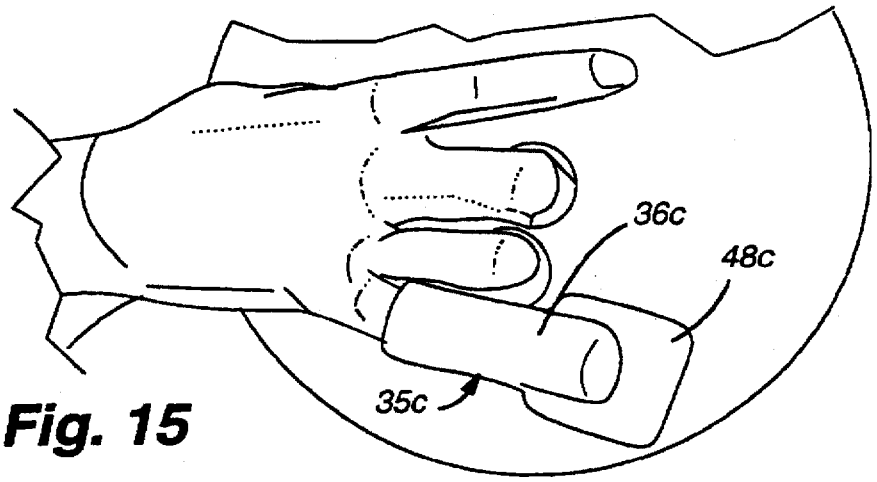
Fig. 15

BOWLING AID

BACKGROUND OF THE INVENTION

1. Field of the Invention

This invention relates to a bowling aid. More particularly, this invention relates to a bowling aid for use on a bowler's hand for gripping the bowling ball.

2. Description of the Prior Art

Bowling is a popular sport at both the leisure and competitive levels. In order to bowl at an intermediate or advanced level, the bowler must be able to swing and release the bowling ball with adequate lift, turn, axis rotation and axis tilt to produce the desired movement and rotation of the bowling ball as the ball travels down the bowling lane prior to striking the pins. The lift, turn, rotation, and tilt all combine to result in a specific path and movement so that the ball strikes the pins at the optimum position to produce the maximum pin count.

Lift is related to the time between when the bowler's thumb disengages from the bowling ball and when the bowler's fingers disengage from the bowling ball. Lift generates the revolution of the bowling ball, with high revolutions being desired. Stronger lift is developed by moving the hand behind and under the bowling ball during the release. This requires considerable strength in the fingers and the rest of the hand, especially the ring finger, which is substantially responsible for the lift generated in a bowling ball during release.

The track of the bowling ball is that portion of its surface contacting the lane as it is moving towards the pins. For present lane surface conditions, the ideal track is called a "semi-roller." This track is on the index finger side of bowling ball when the thumb and middle fingers are inserted into the gripping holes. The track is adjacent to the thumb hole and middle finger gripping hole. The typical track has a length of about 10–12 inches around the bowling ball. Tracks of less than 10 inches are known as "spinner" tracks. They are typically indicative of a weak release, usually derived from minimal lift, early hand turn, or a late exiting thumb. These release variables can act alone or in combination to produce the spinner track. Spinner tracks have low revolution and a difficult time gripping the lane surface, and thus have very little energy when they strike the pins. The track has two axis points. In bowling jargon, the axis point on the small finger side of the hand with the bowler's thumb and two middle fingers inserted into the three gripping holes is termed the positive axis. The opposite axis is termed the negative axis.

During release, the positive axis is rotated by a right handed bowler in a counter clockwise direction. Proper axis rotation will result in the positive axis point centered and facing the bowler just after release. This process of axis rotation is effected through the "turn" which occurs during the release of the ball. The middle finger inserted into the bowling ball is substantially responsible for the "turn" generated during release. Turn is the second key ingredient of a proper release, the first being lift. Both lift and turn occur after the thumb has exited the bowling ball during delivery. Adequate revolutions and axis rotation are not obtained without the proper amount of lift and turn. Inadequate lift and/or turn will reduce the strike power of the bowling ball. The index finger is particularly important in the stabilization of the bowling ball during release and leads the hand in the turning motion. Thus, bowlers with long fingers and strong hands have more potential to lift and turn the bowling ball properly during the release.

As the bowling ball moves down the lane, the positive axis begins to rotate towards the strike pocket. This movement of the axis is called axis tilt. If the bowling ball has been properly turned during the release to establish optimum axis rotation, the energy of the release will be retained long enough to allow the axis tilt to occur as the ball begins to grip the last one-third of lane surface in front of the bowling pins. The axis tilt continues as the ball strikes the pins. Inadequate axis rotation will result in inadequate axis tilt, and thus premature energy release. This produces a weak-hitting bowling ball since the energy of the bowling ball was released prior to striking the pins. In bowling jargon this is called a "roll out".

Bowling balls conventionally have three holes formed therein for receiving the bowler's thumb and middle fingers with the palm of the hand resting on the surface of the ball, and the index and little finger extending along the surface of the bowling ball. The insertion of the fingers into the holes allows the bowler to grip the ball adequately and hold the ball during the back swing and release thereof. The inserted fingers assist in generating the lift, turn, axis rotation, and axis tilt, as described above, necessary for controlling the movement of the bowling ball. The palm, index finger and little finger also contribute to the lift, axis rotation and axis tilt.

A person of normal strength often has a difficult time maximizing the lift, turn, axis rotation, and axis tilt of the bowling ball during release given the relatively small surface area of the index finger, little finger, and palm in contact with the outer surface of the bowling ball. As a result, the bowler's ability to develop into an advanced bowler is limited.

Various devices have been developed in an attempt to address the inherent limitation of the bowler's ability to generate the necessary lift, turn, axis rotation, and axis tilt. Some devices have emphasized improving the grip of the bowler's fingers on the surface of the bowling ball by providing a flexible rubber finger cot which is placed on the finger. This device still only has a surface area in contact with the bowling ball similar in size to the surface area of a natural finger.

Other devices have attempted to improve the bowler's delivery of the bowling ball by spacing certain portions of the bowler's hand and fingers off of the bowling ball. These devices can lift the index finger and pull it off the ball, thereby decreasing the user's grip on the ball and lessening the effectiveness of the finger to which it is applied. Still other devices have attempted to improve the bowler's performance by restricting the movement of the bowler's wrists. Locked wrist devices can inhibit the user's ability to general optimum lift and turn during the release. The locked wrist devices can either produce an excess amount of lift with inadequate turn, or inadequate lift with excessive, early hand turn. In addition, they do not allow free wrist motion through the release.

A flexible sheath for the index finger, with a tacky surface for engagement with the surface of a bowling ball, is disclosed in "Bowling," Jun./Jul., 1984, at page 39. A glove with sheaths for the bowler's index and little fingers and a flexible strap tying the sheaths together, and non-slip surface for engagement with a bowling ball is shown in U.S. Pat. No. 3,595,575 and U.S. Pat. No. 3,224,012. A finger sheath formed of a flexible, resilient material for frictionally engaging a bowling ball is shown in U.S. Pat. No. 3,091,455.

Flexible covers for a bowler's index and little fingers are shown in U.S. Pat. No. 3,248,112. The covers have ribbed surfaces for frictionally engaging the bowling ball. A wrap-around sleeve and integral stiff tongue brace is shown in U.S. Pat. No. 4,194,736.

OBJECTS OF THE INVENTION

It is the principal object of the present invention to provide an improved hand mounted aid which increases the gripping effect of the bowler's hand while holding a bowling ball in order to allow the bowler to generate the desired lift, turn, axis rotation, and axis tilt during and upon release.

Another object of the present invention is to provide an improved hand mounted aid which provides for a quicker thumb release while adding strength to the rest of the gripping hand, to allow a significantly longer time delay between the thumb exiting the gripping hole and the gripping fingers and index finger leaving contact with the bowling ball.

It is another object of the present invention to provide an improved bowling aid of the foregoing character which maximizes the surface area of the bowler's hand while delivering the bowling ball.

It is a further object of the present invention to provide a bowling aid that increases the grip of the bowler's hand while holding a bowling ball during delivery.

It is yet a further object of the present invention to provide a bowling aid that increases the surface area of at least one of the bowler's fingers for contact with the bowling ball during delivery to enhance lift or turn.

SUMMARY OF THE INVENTION

In accordance with the foregoing objects, the present invention is embodied in a bowling aid adapted to be mounted on either the bowler's index or little finger. The aid is in the form of a rigid sheath into which the bowler's finger is inserted. Appropriate padding is provided in the sheath for gripping and protecting the finger. On the outer end of the sheath there is provided a plate which extends outwardly from the sheath and is provided with a concave surface with a frictional coating thereon for assisting the bowler in gripping the bowling ball, the concave surface and friction coating extending along the length and width of the sheath. The bowler presses the plate and the length and width of the sheath against the surface of the ball during bowling to generate enhanced grip. The enhanced grip which is thus achieved greatly assists the bowler in generating lift and turn, increasing ball revolutions and generating proper axis rotation and axis tilt during bowling.

BRIEF DESCRIPTION OF THE DRAWINGS

FIG. 3 is an enlarged perspective view of a bowling aid embodying the present invention.

FIG. 4 is an enlarged top plan view of the bowling aid shown in FIG. 3.

FIG. 5 is a side elevation view of the bowling aid shown in FIG. 4.

FIG. 12 is a top plan view of the bowling aid shown in FIG. 9.

FIG. 13 is a top plan view of another alternative embodiment of a bowling aid embodying the present invention. FIG. 14 is a section view substantially in the plane of line 14—14 on FIG. 12.

FIG. 15 is a top plan view of the bowling ball and hand, illustrating the use of an alternative embodiment of the present invention.

DETAILED DESCRIPTION

Figure 1:
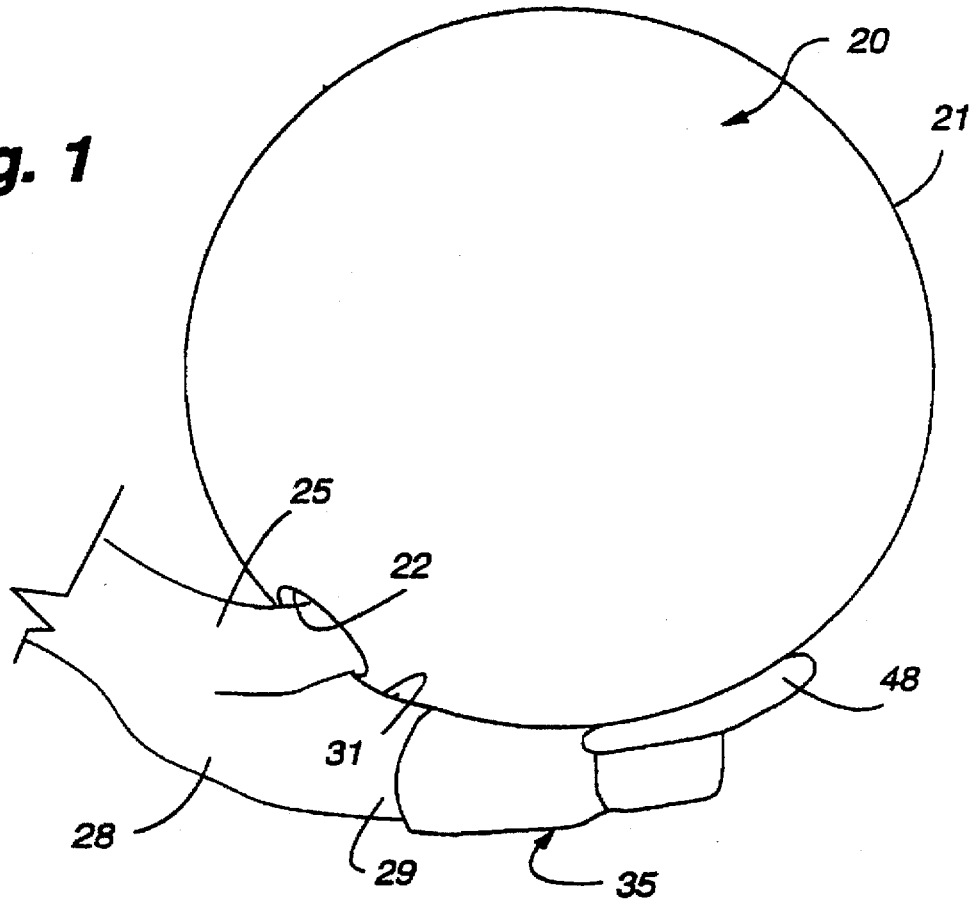
FIG. 1 is an elevation view of a bowling ball, held in a bowler's hand equipped with a bowling aid embodying the present invention.
Figure 2:
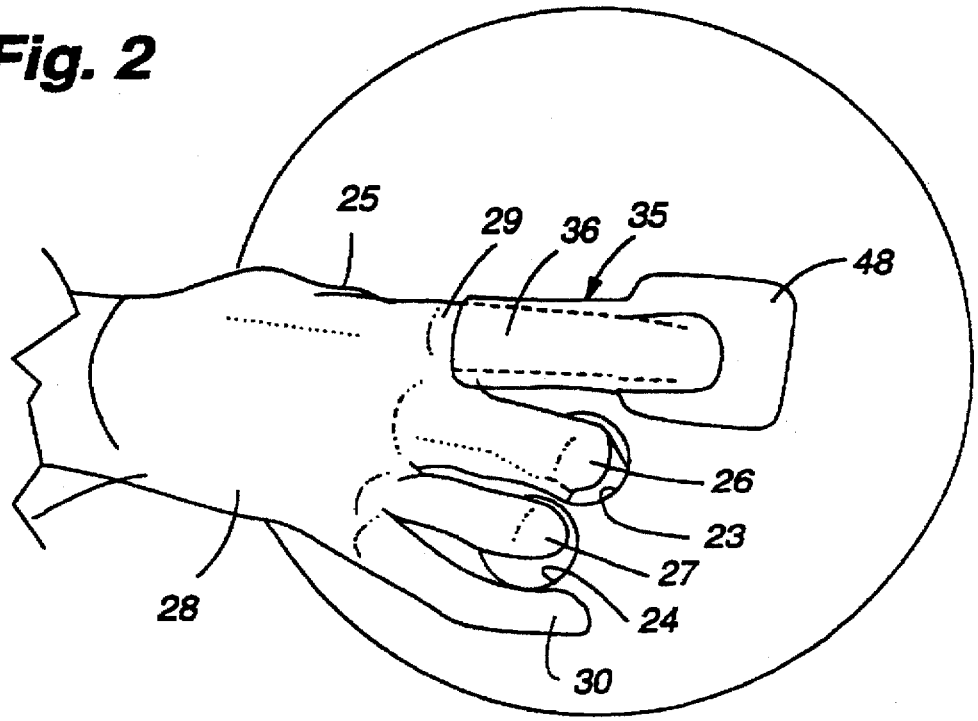
FIG. 2 is a top plan view of the bowling ball and hand shown in FIG. 1.

As shown in the drawings, a bowling ball 20, conventionally made of a hard material, defines a spherical outer surface 21. A plurality of apertures 22, 23, 24 are conventionally drilled in the bowling ball 20 for receiving respectively the thumb 25 and two middle fingers 26, 27 of the bowler's hand 28. The index finger 29, little finger 30, and the bowler's palm 31 normally rest on and grip the outer surface 21 of the bowling ball 20 when the bowling ball is held by the bowler.

The preferred embodiment of a bowling aid 35 embodying the present invention, as shown in FIGS. 1–8, is a rigid sheath for application to the index finger 29 of the bowler's hand 28 and is formed as a tubular main body 36 defining a bore 38 extending continuously therethrough from a first end finger receiving opening 39 to a second end opening 40. The tip of the index finger of the bowler is inserted through the first opening 39 into the bore 38, and is snugly held therein by a resilient insert sleeve 41. A resilient cushion 42 is provided in the tubular sheath 36 for padding the upper portion of the bowler's finger to provide a snug fit and prevent injury thereto.

The insert 41 may be removable from the bowling aid. To this end, the insert 41 fits in a cavity 44 defined within the outer shell 36, and dimensioned to receive the insert 41. The insert 41 is held in the recess by an inwardly extending flange 45 spaced from the opening formed at the second end of the main body, and an internal shoulder 46 adjacent the outer end of the shell 36. The insert 41 is positioned within the recess by compressing and inserting the insert through the aperture 40 formed in the end of the main body, and releasing the insert so that it expands to its normal dimensions and is securely held within the recess 44. The insert can likewise be removed in the same manner.

Figure 6:
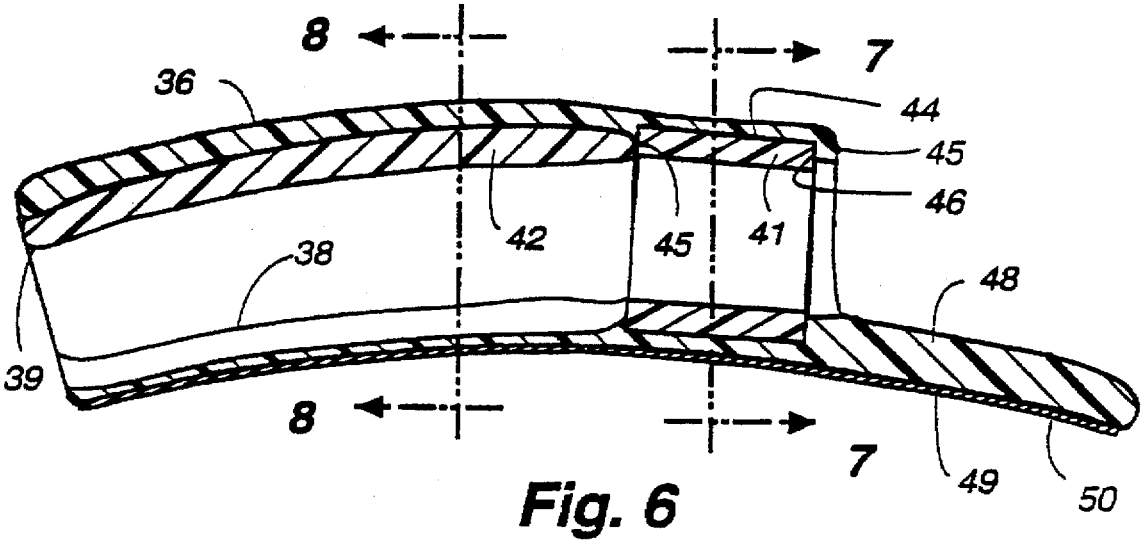
FIG. 6 is a section view taken substantially in the plane of line 6—6 of FIG. 4.
Figure 6A:
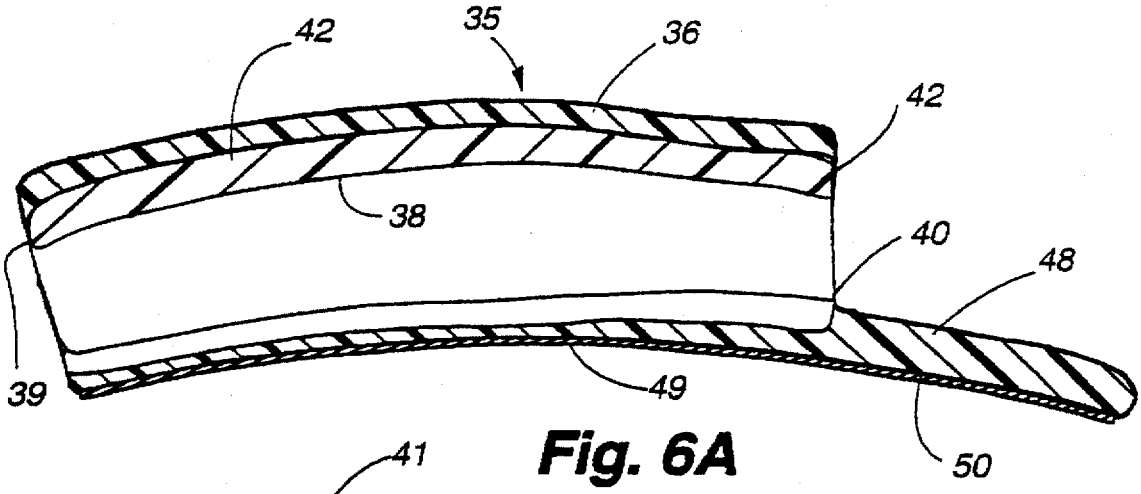
FIG. 6A is a representational section view of an alternative embodiment of the present invention.
Figure 7:
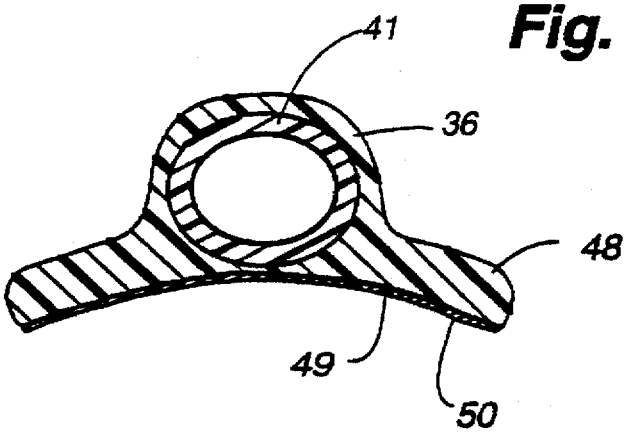
FIG. 7 is a section view taken substantially in the plane of line 7—7 on FIG. 6.
Figure 8:
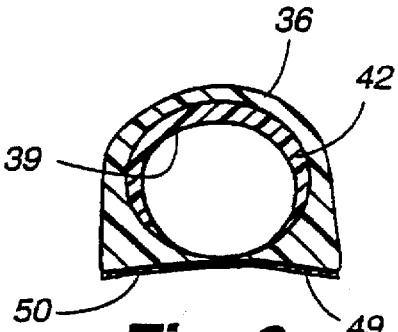
FIG. 8 is a section view taken substantially in the plane of line 8—8 on FIG. 6.
Figure 9:
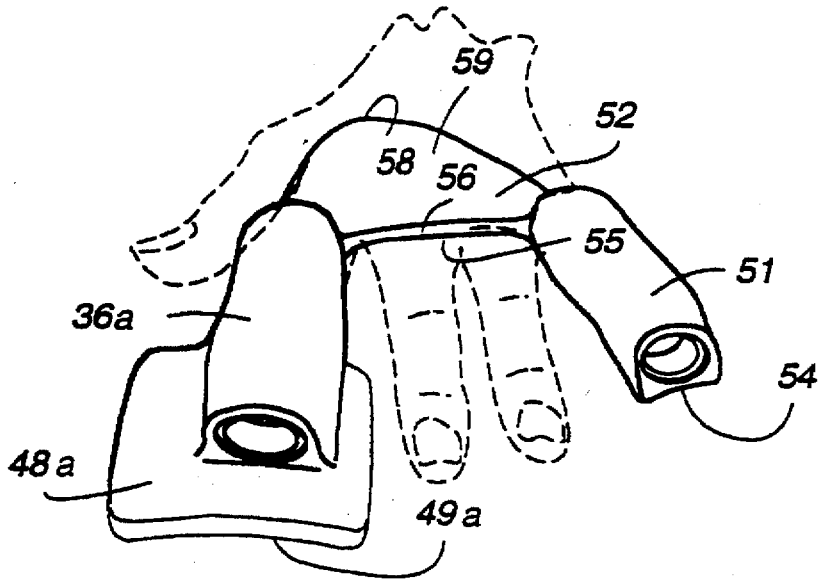
FIG. 9 is a front perspective view of a bowler's hand with an alternative embodiment of the bowling aid embodying the present invention.
Figure 10:
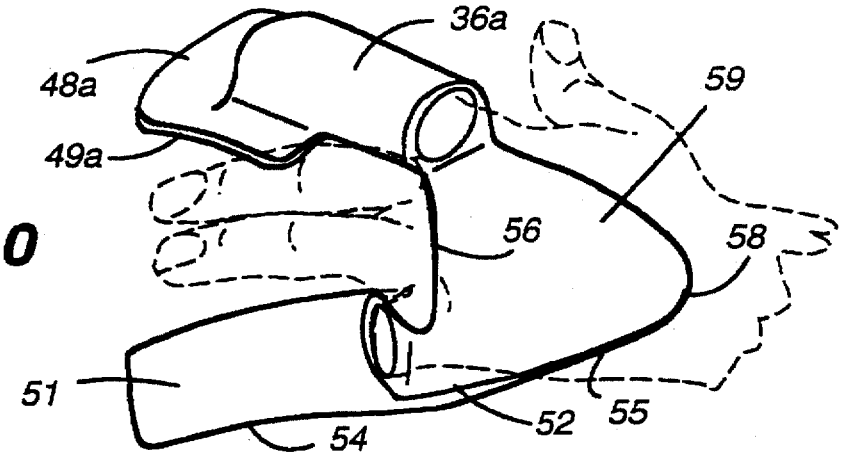
FIG. 10 is a rear perspective view of the hand and bowling aid shown in FIG. 9.

Alternatively, the entire length of the sheath 36 can have resilient cushion 42 extending inside the sheath 36 from the first end finger receiving opening 39 to the second end opening 40, as shown in FIG. 6A. The tip of the index finger of the bowler is inserted through the first opening 39 into the bore 38, and is snugly held therein along its length by the resilient foam 42, without the insert 41 being necessary. The resilient cushion 42 is provided in the tubular sheath 36 for padding the upper portion of the bowler's finger along its entire length, and to provide a snug fit and prevent injury thereto.

A bottom surface 49 of the sheath body 36 engages the surface 21 of the bowling ball 20. In addition, an enlarged plate or paddle 48 can be integrally formed on the sheath body 36 to extend laterally outwardly from the sides and longitudinally outwardly the forward end of the sheath 36. The plate or paddle 48 is formed with a bottom surface integral with bottom surface 49 of the sheath body 36 having a concave spherical curvature identical to the curvature of the outer surface 21 of the bowling ball 20. The bottom surface 49 is preferably covered with a gripping material 50, such as an elastomer or latex layer, to provide a frictional gripping engagement with the surface 21 of the ball 20.

The paddle 48 is integrally formed with and extends outwardly from the main body sheath 36 as an extension thereof. Like the main body sheath 36, the paddle is relatively rigid. The paddle preferably extends past the forward end of the sheath body 36 to an extent up to about 50% of the length of the sheath body, and is generally square in shape. The shape of the paddle can be modified as desired by the bowler.

A modified embodiment of the bowling aid of the present invention is shown in FIGS. 9–14. In describing this embodiment, like elements to those described above will be indicated by similar reference numerals with the distinguishing suffix "a."

The alternative embodiment of the bowling aid (FIGS. 9–14) includes a main rigid sheath body **36*a* for receiving the bowler's index finger 29 and a second sheath 51 for receiving the little finger 30. The two main sheaths 36*a*, 51 are attached together by a rigid bridge 52 extending between the index finger main body 36*a* and the little finger main body 51 adjacent the first ends thereof. The main body 36*a* for the index finger is made identically to the main body as described above, and includes a plate or paddle 48*a* and ball contact surface 49*a*. The main body 51 for receiving the little finger is constructed identically to the main body 36*a* for receiving the index finger, with necessary modifications made in light of the differences in size of the two fingers. The main body sheath 51 for receiving the little finger may or may not include a paddle, but does define a spherical concave ball contact surface 54** along its length and width.

Figure 11:
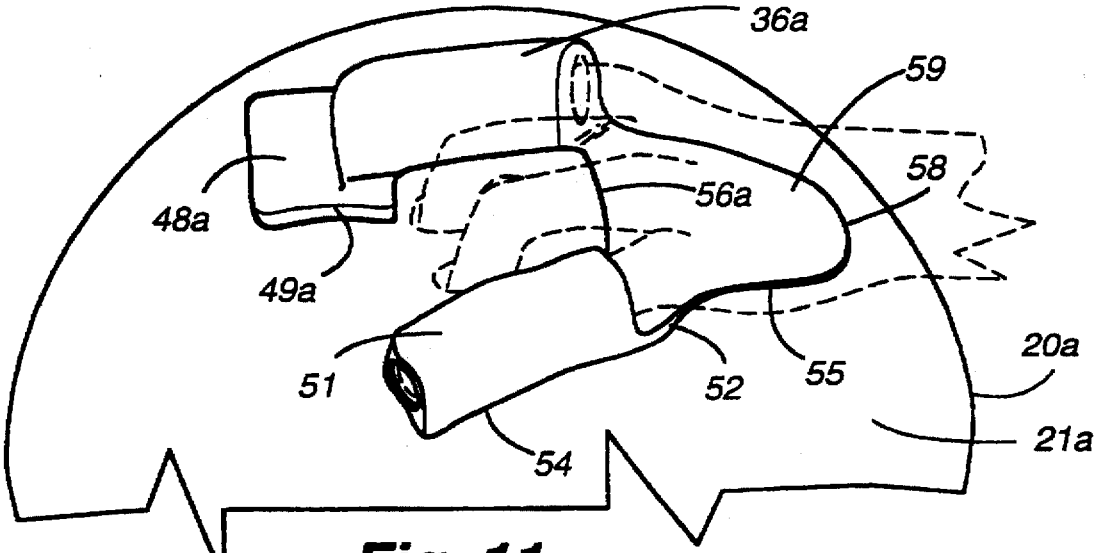
FIG. 11 is a side perspective view of the bowling aid shown in FIG. 9 as positioned on a bowling ball.

The bridge 52 connecting the index finger main body **36*a* and the little finger main body 51 is integrally formed with each of the main body sheaths, and defines a spherical contact surface ball 55 coextensive with the contact surfaces of the two main bodies, as shown in FIG. 14. The bridge 52 is formed by a thin, rigid plate defining a front edge 56 and a rear edge 58. The front edge 56 lies between the finger sheaths 36*a*, 51 and forwardly of the finger receiving ends thereof. The rear edge 58 of the bridge 52 extends rearwardly from the sheaths to be under the palm 31 of the bowler's hand. The ball contact surfaces 49*a*, 54 of the sheaths and bridge surface 55 coextensively engage the outer surface 21*a* of a bowling ball 20*a* when in use, as shown in FIG. 11**.

The bridge 52 also defines an upper surface 59 on which a thin cushion material 60 (FIG. 14) may be affixed to help ensure contact with the bowler's hand during use. The cushion layer 60 can be made of a closed-cell foam which adapts to the individual shape of the bowler's hand, yet has adequate firmness to maximize the bowler's feel and control of the bowling ball.

A further modified embodiment of the bridge is shown in FIG. 13. In describing this modification, reference characters similar to those used above will be employed with the distinguishing suffix "b." In this modification, the bridge **52*b* is narrow and extends between the first ends of the index finger sheath 36*b* and the little finger sheath 51*b*. The palm of the bowler thus does not cover the bridge 52*b*. The bridge 52*b* essentially underlies the base of the knuckles of the bowler. This smaller bridge 52*b* also has a contact surface (not shown) having the same spherical curvature as the larger bridge member to ensure complete contact with the bowling ball during use. The contact surface of the bridge member as well as the index finger sheath 36*b*, paddle 48*b*, and little finger sheath 51*b*** all have a gripping or frictional material applied thereto (not shown), to provide enhanced gripping characteristics.

Another modified embodiment of the bowling aid of the present invention is shown in FIG. 15. In describing this embodiment, like elements to those described above will be indicated by similar reference numerals with the distinguishing suffix "c."

This alternative embodiment of a bowling aid **35*c* embodying the present invention, as shown in FIG. 15, includes a sheath 36*c* which is identical to the sheath 36 described above, except that the sheath is sized and dimensioned to be worn on a bowler's little finger. This version of the a rigid sheath 36*c* for application to the little finger can have a paddle 48*c*** as desired.

In use, the bowling aid of the present invention increases the ball contact surface area of the bowler's finger, which in turn enhances the bowler's ability to generate the lift, turn, axis rotation and axis tilt upon release of the bowling ball.

The bowling aid, when used, allows the fingers of the bowler to stay on the ball longer, but creates earlier thumb exit, and in combination with the increased surface area and frictional contact between the bowling aid and the bowling ball, assists the bowler in generating lift and turn with natural wrist action through the release, and thus increasing ball revolutions and helping to obtain proper axis rotation and axis tilt, thereby helping to improve the bowler's score.

Given the fact that the middle finger substantially controls the turn performance, and the ring finger substantially controls the lift performance, the bowling aid can be worn only on the index finger to improve a bowler's turn performance, and can be worn only on the little finger to improve the bowler's lift (revolution) performance. The combination index and little finger bowling aids 35, with the rigid bridge connecting the two, as described above, can be used to improve both lift and turn performance simultaneously. Generally, the bowling aid of the present invention works in a number of ways to strengthen any of a variety of weaknesses from which a bowler may suffer. The bowling aid can stabilize the bowling ball in the user's hand, provide a feel for a better overall swing, and assist in proper release for improved lift, turn, axis rotation and axis tilt.

Although the present invention has been described with a certain degree of particularity, it is understood that the present disclosure has been made by way of example, and changes in detail or structure may be made without departing from the spirit of the invention, as defined in the appended claims.

I claim:

1. A bowling aid for placement on a finger of a bowler's hand for enhancing a bowler's control of a bowling ball, a bowling ball having a spherical outer surface, said bowling aid comprising:

a first sheath defining a bore for snugly receiving a bowler's finger;

a plate attached to a free end of said sheath and extending outwardly from said sheath, said sheath and said plate having a lower surface shaped to conform to and engage an outer surface of a bowling ball when pressed against the ball by the bowler's finger.

2. A bowling aid as defined in claim 1, wherein said plate defines a partially spherical concave lower surface for engagement with the outer surface of the ball.

3. A bowling aid as defined in claim 1 wherein said sheath encloses a flexible resilient sleeve adapted to snugly receive the tip of the bowler's finger.

4. A bowling aid as defined in claim 3 further comprising a flexible resilient pad positioned within said bore of said sheath and adapted to engage and pad the bowler's finger.

5. A bowling aid as defined in claim 1 wherein said sheath is rigid.

6. A bowling aid for placement on a finger of a bowler's hand for enhancing a bowler's control of a bowling ball, a bowling ball having a spherical outer surface, said bowling aid comprising:

a first sheath defining a bore for snugly receiving a bowler's finger;

a plate attached to a free end of said sheath and extending outwardly from said sheath, said sheath and said plate having a lower surface shaped to engage an outer surface of a bowling ball when pressed against the ball by the bowler's finger:

a second sheath defining a second bore adapted for receiving another of the bowler's fingers; and a bridge attached to and spanning between said first and second sheaths.

7. A bowling aid as defined in claim 6 wherein said plate defines a lower surface, and said first and second sheaths and said bridge each define a lower surface, said lower surfaces having a partial spherical shape to coextensively engage the outer surface of the bowling ball.

8. A bowling aid as defined in claim 7, wherein said bridge extends substantially entirely beneath a bowler's hand.

9. A bowling aid as defined in claim 8, wherein:

said bridge has a top surface adapted for engagement with a bowler's hand and a cushion material is fixed to said top surface of said bridge.

10. A bowling aid as defined in claim 6, wherein said bridge has a top surface adapted for engagement with a bowler's hand, and further comprises a cushion material fixed to the top surface.

11. A bowling aid for placement on a bowler's finger, the finger having a width, for enhancing a bowler's control of a bowling ball having a spherical outer surface, said bowling aid comprising:

a first sheath defining a bore adapted for snugly receiving a bowler's finger, said sheath having opposing ends and a bottom surface substantially wider than the width of a bowler's finger, and defining a partially spherical concave shape to coextensivety engage the outer surface of a bowling ball; and a plate attached to and extending outwardly from one of said opposing ends of said sheath, said plate having a bottom surface wider than the bottom surface of said sheath, and being integrally formed with said bottom surface of said sheath, said bottom surface of said plate shaped to conform to and coextensively engage the outer surface of a bowling ball.

12. A bowling aid as defined in claim 11, wherein the bottom surface is coated with a frictional material.

13. A bowling aid for placement on a bowler's finger, the finger-having a width, for enhancing a bowler's control of a bowling ball having a spherical outer surface, said bowling aid comprising:

a first sheath defining a bore adapted for snugly receiving a bowler's finger, said sheath having opposing ends and a bottom surface substantially wider than the width of a bowler's finger, and defining a partially spherical concave shape to coextensively engage the outer surface of a bowling ball; and a plate attached to and extending outwardly from one of said opposing ends of said sheath, said plate having a bottom surface wider than the bottom surface of said sheath, and being integrally formed with said bottom surface of said sheath, said bottom surface of said plate shaped to coextensively engage the outer surface of a bowling ball;

a second sheath, defining a bottom surface, for snugly receiving a bowler's little finger; and a bridge integral with said first sheath and second sheath.

14. A bowling aid as defined in claim 13, wherein said second sheath has a plate attached to and extending outwardly from said second sheath, said plate having a bottom surface coextensively formed with said bottom surface of said second sheath to coextensively engage the surface of the bowling ball.

15. A bowling aid as defined in claim 14 wherein said bridge extends between said first and second sheath, and said bridge has a width dimension transverse to the extension of said bridge, and is enlarged in said width dimension to extend beneath a palm of a bowler's hand.

16. A bowling aid as defined in claim 14, wherein said bridge has a top surface adapted for engagement with a bowler's hand, and further comprises a cushion material fixed to the top surface.

17. A bowling aid as defined in claim 14, wherein said enlarged bridge has a bottom surface integral with said bottom surface of said second sheath and said bottom surface of said first sheath, said bottom surface of each of the bridge, second sheath and first sheath together forming a spherical concave shape for coextensive engagement with the surface of the bowling ball.

18. A bowling aid for placement on a finger of a bowler's hand for enhancing a bowler's control of a bowling ball, the bowling ball having a spherical outer surface, said bowling aid comprising:

a sheath for supportively receiving a bowlers finger; and a plate attached to a free end of said sheath and extending outwardly from said sheath, said sheath and said plate having an integratly formed bottom surface shaped to conform to and engage an outer surface of a bowling ball when pressed against a bowling ball by a bowler's finger.

19. A bowling aid for placement on a finger of a bowler's hand for enhancing a bowler's control of a bowling ball, the bowling ball having a spherical outer surface, said bowling aid comprising:

a sheath having a first and second opposing ends and defining a bore for snugly receiving a bowler's finger;

a plate attached to one of said first or second ends of said sheath and extending outwardly from said sheath, said sheath and said plate having a lower surface shaped to conform to and engage an outer surface of a bowling ball when pressed against a ball by a bowler's finger.

20. A bowling aid as defined in claim 19, wherein said plate defines a partially spherical concave lower surface for engagement with the outer surface of the ball.

21. A bowling aid as defined in claim 19 wherein said sheath encloses a flexible resilient sleeve adapted to snugly receive the tip of the bowler's finger.

22. A bowling aid as defined in claim 21 further comprising a flexible resilient pad positioned within said bore of said sheath and adapted to engage and pad the bowler's finger.

23. A bowling aid for placement on a finger of a bowler's hand for enhancing a bowler's control of a bowling ball, a bowling ball having a spherical outer surface, said bowling aid comprising:

a first sheath defining a bore for snugly receiving a bowler's finger;

a plate attached to a free end of said sheath and extending outwardly from said sheath, said sheath and said plate having a lower surface shaped to engage an outer surface of a bowling ball when pressed against the ball by the bowler's finger;

a second sheath defining a second bore adapted for receiving a bowler's little finger; and a bridge attached to and spanning between said index finger sheath and said little finger sheath.

24. A bowling aid as defined in claim 23 wherein said plate defines a lower surface, and said first and second sheaths and said bridge each define a lower surface, said lower surfaces having a partial spherical shape to coextensively engage the outer surface of the bowling ball.

25. A bowling aid as defined in claim 24 wherein said bridge is enlarged and is adapted to extend beneath the bowler's hand.

26. A bowling aid as defined in claim 23, wherein said bridge has a top surface adapted for engagement with the bowler's hand, and further comprises a cushion material fixed to the top surface.

27. A bowling aid for placement on a bowler's finger, the finger having a width, said bowling aid for enhancing a bowler's control of a bowling ball having a spherical outer surface, said bowling aid comprising:

a first sheath having a first and second ends, and defining a bore adapted for snugly receiving a bowler's finger, said sheath having a bottom surface substantially wider than the width of a bowler's finger, and defining a partially spherical concave shape for conforming to and coextensively engaging the surface of a bowling ball; and a plate attached to and extending outwardly from one of said ends of said sheath, said plate having a bottom surface wider than the bottom surface of the sheath, and being integrally formed with said bottom surface of said sheath to coextensively engage an outer surface of a bowling ball.

* * * * *